US009567134B1

(12) United States Patent
Graves

(10) Patent No.: US 9,567,134 B1
(45) Date of Patent: Feb. 14, 2017

(54) METHOD AND APPARATUS OF PERSONAL STAIN IDENTIFICATION

(71) Applicant: Victoria Graves, Moline, IL (US)

(72) Inventor: Victoria Graves, Moline, IL (US)

( * ) Notice: Subject to any disclaimer, the term of this patent is extended or adjusted under 35 U.S.C. 154(b) by 506 days.

(21) Appl. No.: 13/839,856

(22) Filed: Mar. 15, 2013

Related U.S. Application Data

(60) Provisional application No. 61/736,941, filed on Dec. 13, 2012.

(51) Int. Cl.
*B05D 1/26* (2006.01)
*B65D 25/00* (2006.01)

(52) U.S. Cl.
CPC ..... *B65D 25/00* (2013.01); *B05D 1/26* (2013.01)

(58) Field of Classification Search
None
See application file for complete search history.

(56) References Cited

U.S. PATENT DOCUMENTS 5,791,252 A * 8/1998 Egan ..... B41K 1/06 101/483
5,909,709 A * 6/1999 An ..... B41K 1/02 101/109

OTHER PUBLICATIONS

Alibaba.com, "7ml tubular injuction glass vials with logo printing at the bottom," Dec. 14, 2011, alibaba.com/product-gs/.../7ml_tubular_injuction_glass_vials_with.html.
Cobblestone Mountain's Fir-King Mub Web Site, "Fire King Mug Bottom Stamps," Dec. 14, 2011, www.firekingmugs.com/bottom_stamps.html.
Quality Logo Products, Inc., "Ceramic Removable Soft Bottom Mug (15 oz.)," Dec. 14, 2011, qualitylogoproducts.com/.../ceramic-removable-softbottom-mug 15 oz.htm.
Whatdoyouneed.com, "Custom Inprinted Rubber Bottom Mugs," Dec. 14, 2011, www.whatdoyouneed.com/rubberbottommugs.htm.

* cited by examiner

*Primary Examiner* — Shamim Ahmed
*Assistant Examiner* — Bradford Gates
(74) *Attorney, Agent, or Firm* — Hamilton IP Law, PC; Jay R. Hamilton; Charles A. Damschen

(57) ABSTRACT

A beverage container comprising a base, a side surface, an upper end, and an interior volume formed by the base and the side surface, and a personal identifier positioned upon the base of the of beverage container for stain identification and personalization. A method of using a beverage container for personalization of a stain generated by spilling liquid upon a first surface from the beverage container and transferring a portion of the liquid spilled using the surface of the personal identifier affixed to the beverage container to a second (dry) surface, which may be paper.

9 Claims, 7 Drawing Sheets

METHOD AND APPARATUS OF PERSONAL STAIN IDENTIFICATION

CROSS-REFERENCE TO RELATED APPLICATIONS

Applicant claims priority from provisional U.S. Pat. App. No. 61/736,941 filed on Dec. 13, 2012, which is incorporated by reference herein in its entirety.

FIELD OF THE INVENTION

The present invention relates to a unique method and apparatus for identifying and marking a spill for novelty purposes, particularly a stain in a personally identifiable form.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION-ELEMENT LISTING

Figure 1:
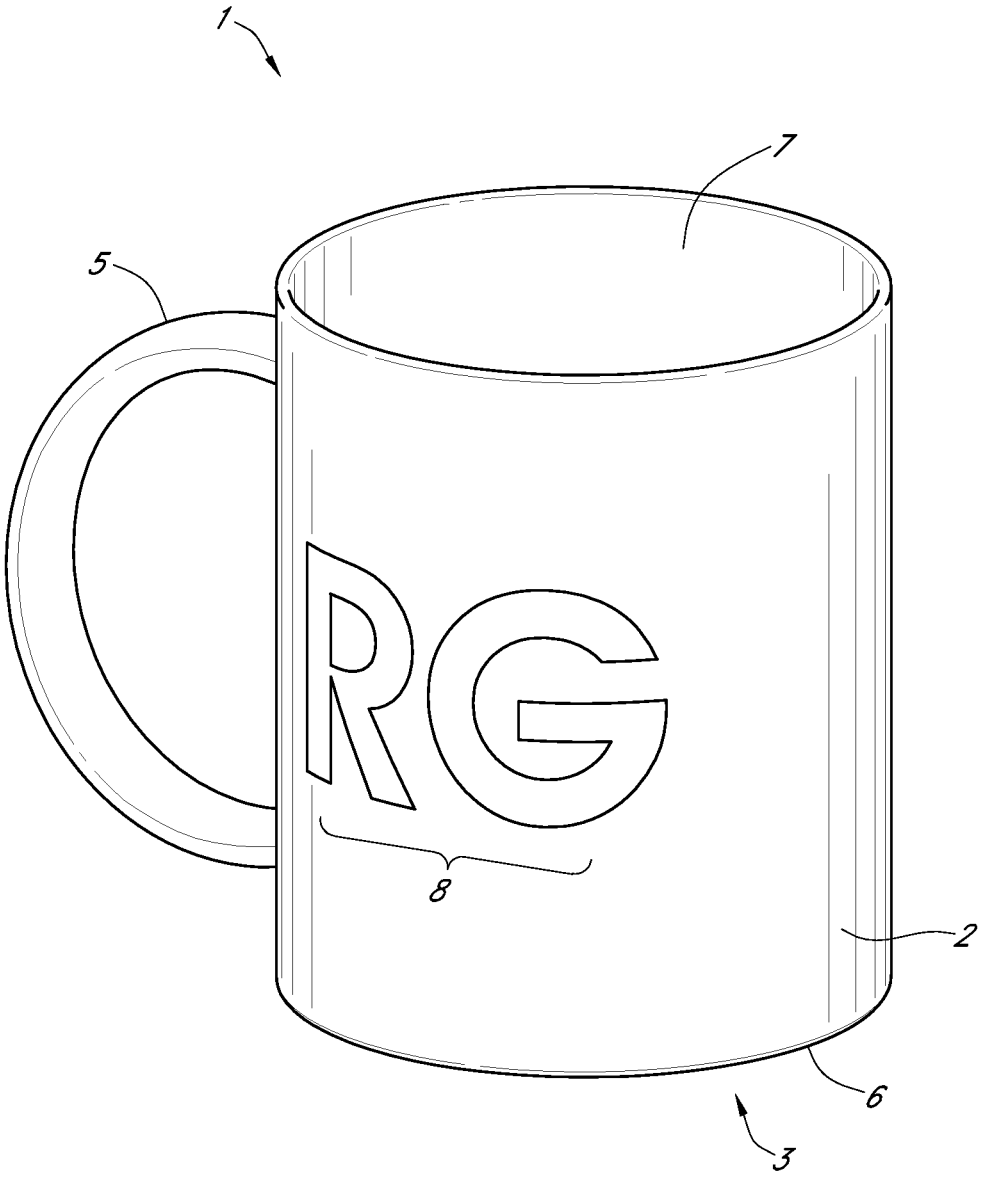
FIG. 1 is a front perspective view of a beverage container.

| Description | Element No. |
|---|---|
| Beverage container | 1 |
| Side Surface | 2 |
| Base | 3 |
| Upper End | 4 |
| Handle | 5 |
| Rim | 6 |
| Interior Volume | 7 |
| Personal Identifier | 8 |
| Displacement Channel | 9 |
| N/A | 10 |
| Spilled Liquid | 11 |
| Liquid | 12 |
| Personally Identifiable Stain | 13 |
| Wet Surface | 14 |
| N/A | 15 |
| N/A | 16 |
| N/A | 17 |
| Dry Surface | 18 |

DETAILED DESCRIPTION

Before the various embodiments of the present invention are explained in detail, it is to be understood that the invention is not limited in its application to the details of construction and the arrangements of components set forth in the following description or illustrated in the drawings.

The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Illustrative Embodiment

The present invention relates to a unique method and apparatus for identifying and marking a stain resulting from a spill for novelty purposes, as illustrated by a beverage container 1, such as a coffee mug (shown) or drinking glass (not shown), without limitation, as shown in FIGS. 1-5 herein.

Figure 2:
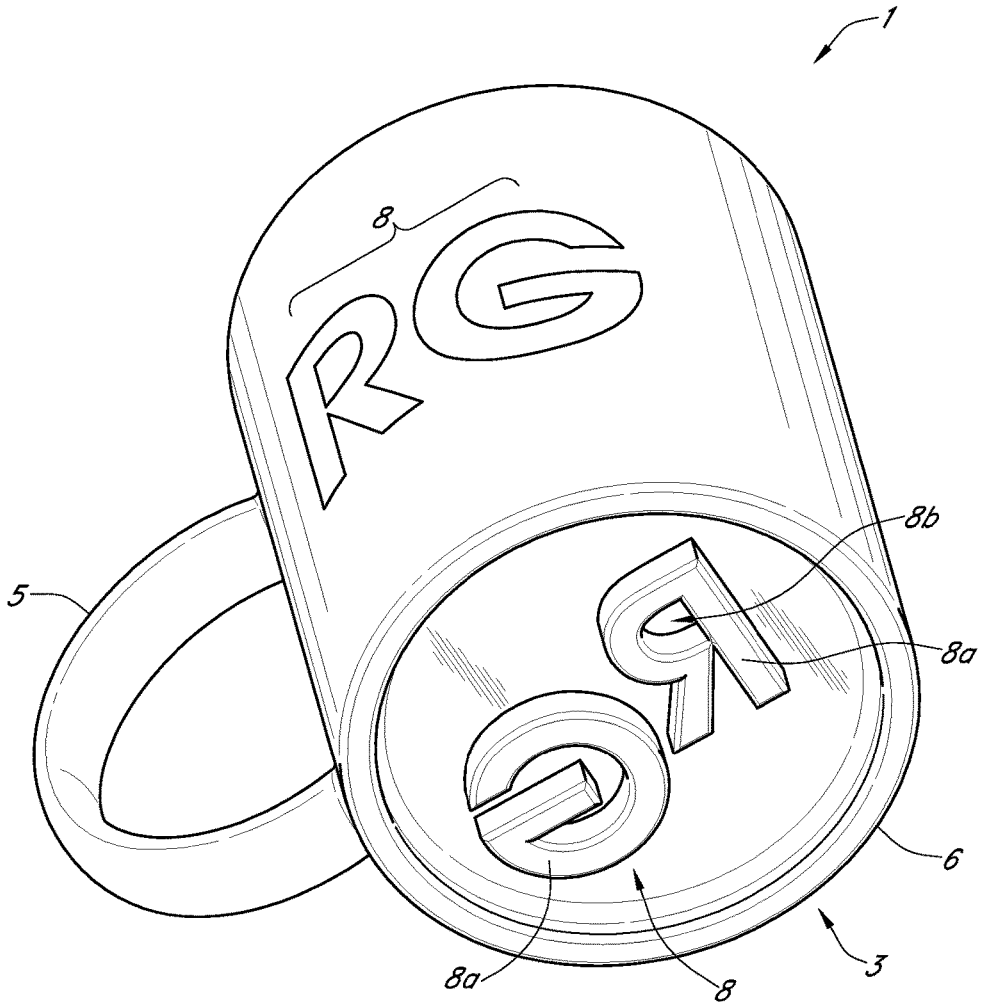
FIG. 2 is a bottom perspective view of the beverage container of FIG. 1.
Figure 3A:
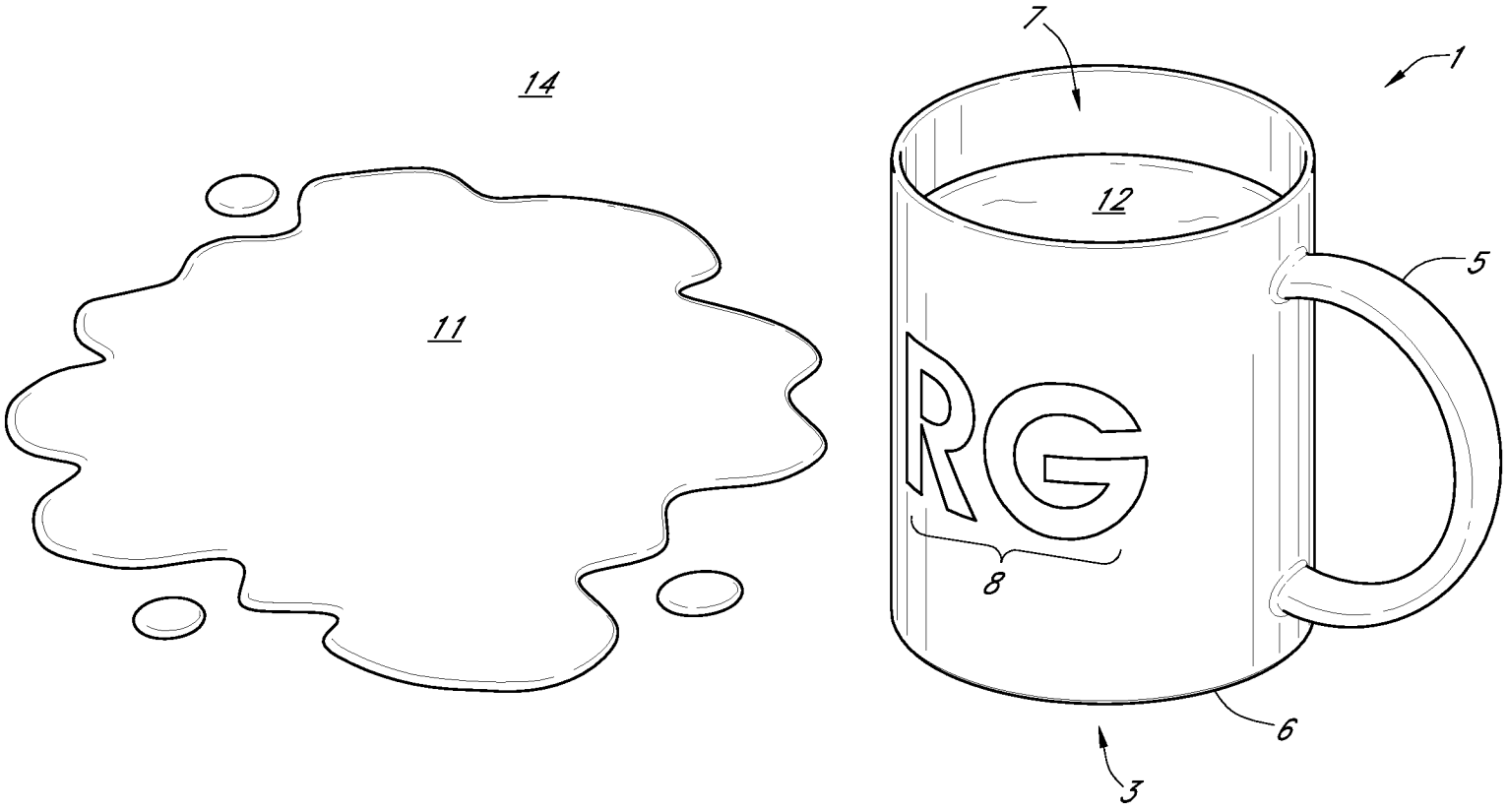
FIG. 3A is a perspective view of the beverage container next to a spill.
Figure 3B:
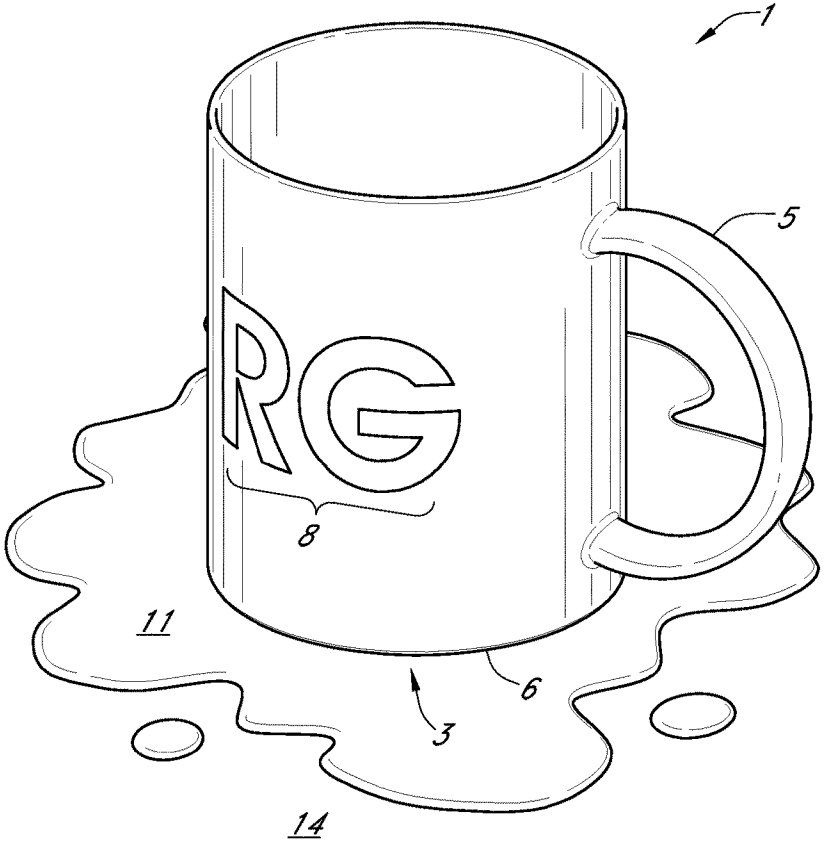
FIG. 3B is a perspective view of the beverage container positioned in the liquid of the spill.
Figure 3C:
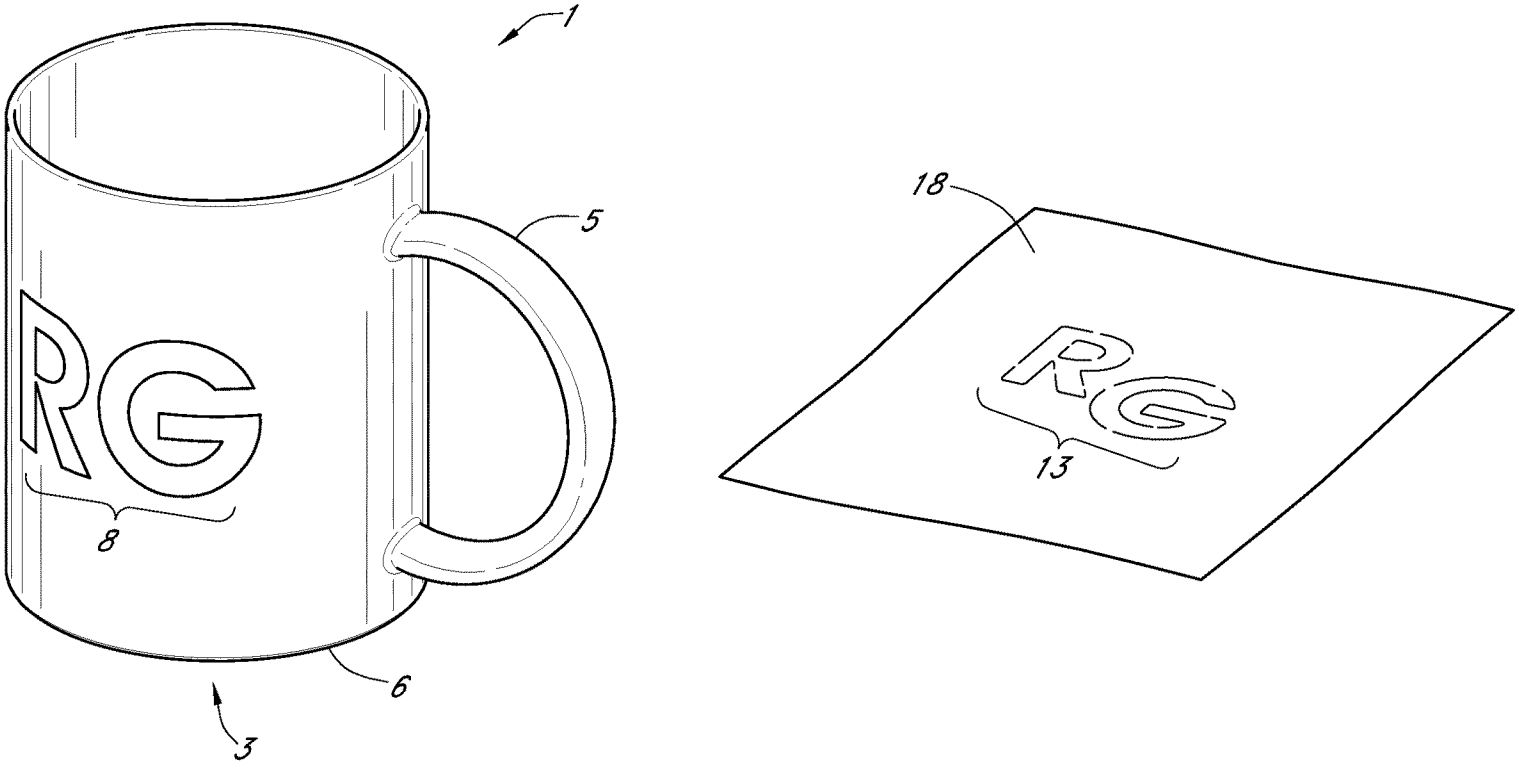
FIG. 3C is a perspective view of the personally identifiable stain.
Figure 5:
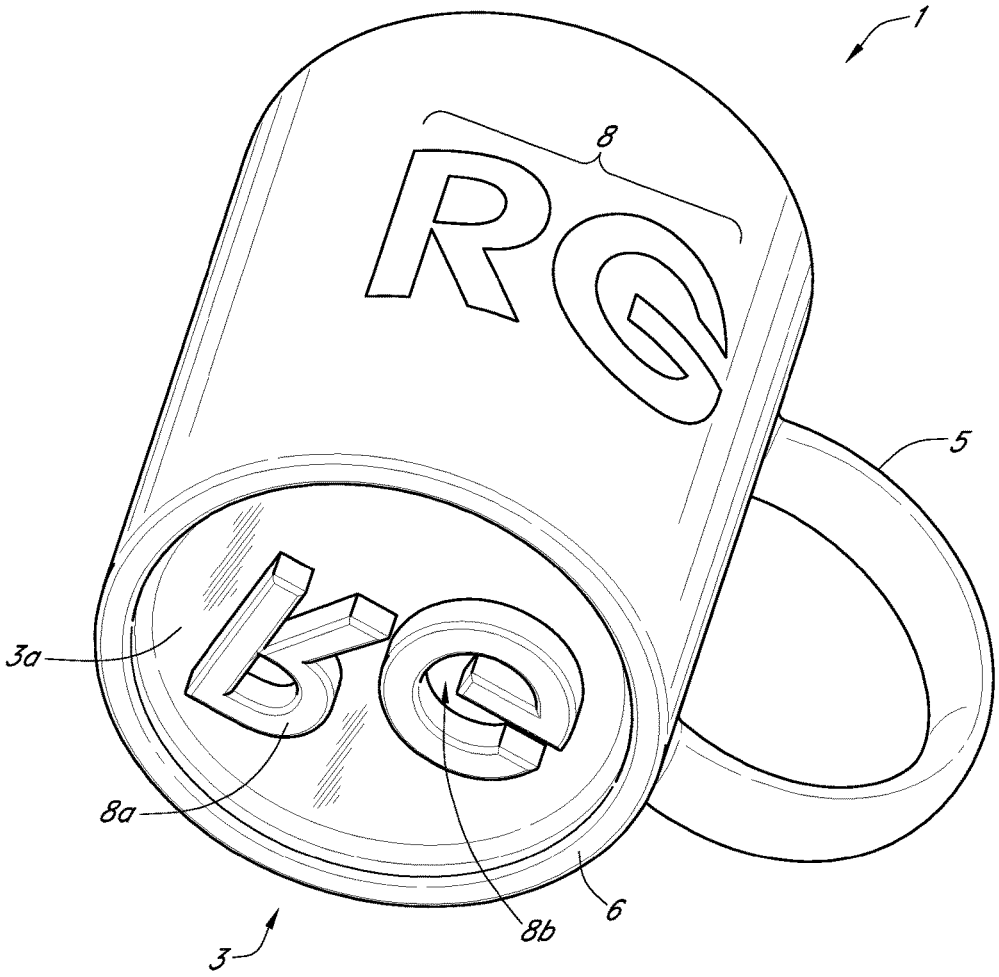
FIG. 5 is a bottom perspective view of the beverage container embodied in FIG. 4.

As shown in FIGS. 1-3, the beverage container 1 comprises a base 3, a side surface 2, an upper end 4, and an interior volume 7 formed by the base 3 and the side surface 2. A personal identifier 8 is positioned upon the base 3 of the beverage container 1 as shown in FIGS. 2 and 5. The base 3 of the beverage container 1 may also have a rim 6 formed at the intersection of the base 3 and the lower portion of the side surface 2. The formation and existence of a rim 6 is dependent on the details of fabrication of the beverage container 1 which are well known to those of ordinary skill.

A personal identifier 8 may also be positioned on the side surface 2, as shown in FIGS. 1-5, but is not required (not shown). The personal identifier 8 positioned upon the side surface 2 (opposite the interior volume 7) of the beverage container 1 is illustrated in FIGS. 1-5. One of ordinary skill will appreciate that the personal identifier 8 affixed to the side surface 2 may be affixed in any matter including embossing, affixation, printing, painting or some combination of the aforementioned. The personal identifier 8 positioned at the base 3 may be affixed as the mirror image of the personal identifier 8 affixed at the side surface 3, as illustrated by FIGS. 2 and 5.

As one of ordinary skill will appreciate, the personal identifier 8 can be positioned upon the base 3 of the beverage container 1 in a multitude of ways including, without limitation, by attachment to the base 3, with portions extending from the base (8*a*), as shown in FIGS. 2 and 5 or through formation in the base, with portions recessed (not shown). Either method of construction or fabrication is well known to those of ordinary skill in the art and does not require further elaboration herein. As shown, the personal identifier 8 should allow a portion of spilled liquid 11 to encompass a portion of the personal identifier 8 thereby wetting a portion of the surfaces (8*a*) and leaving others portions dry (8*b*). One of ordinary skill will appreciate that the capacity of liquid 11 to discolor stain should be sufficient to leave the surface 18 with some discoloration related to the transfer of the liquid 11 to surface 18, i.e. spilling clear liquids is likely to have less effect than darker, non-opaque liquids such as coffee, cola and grape juice.

Figure 4:
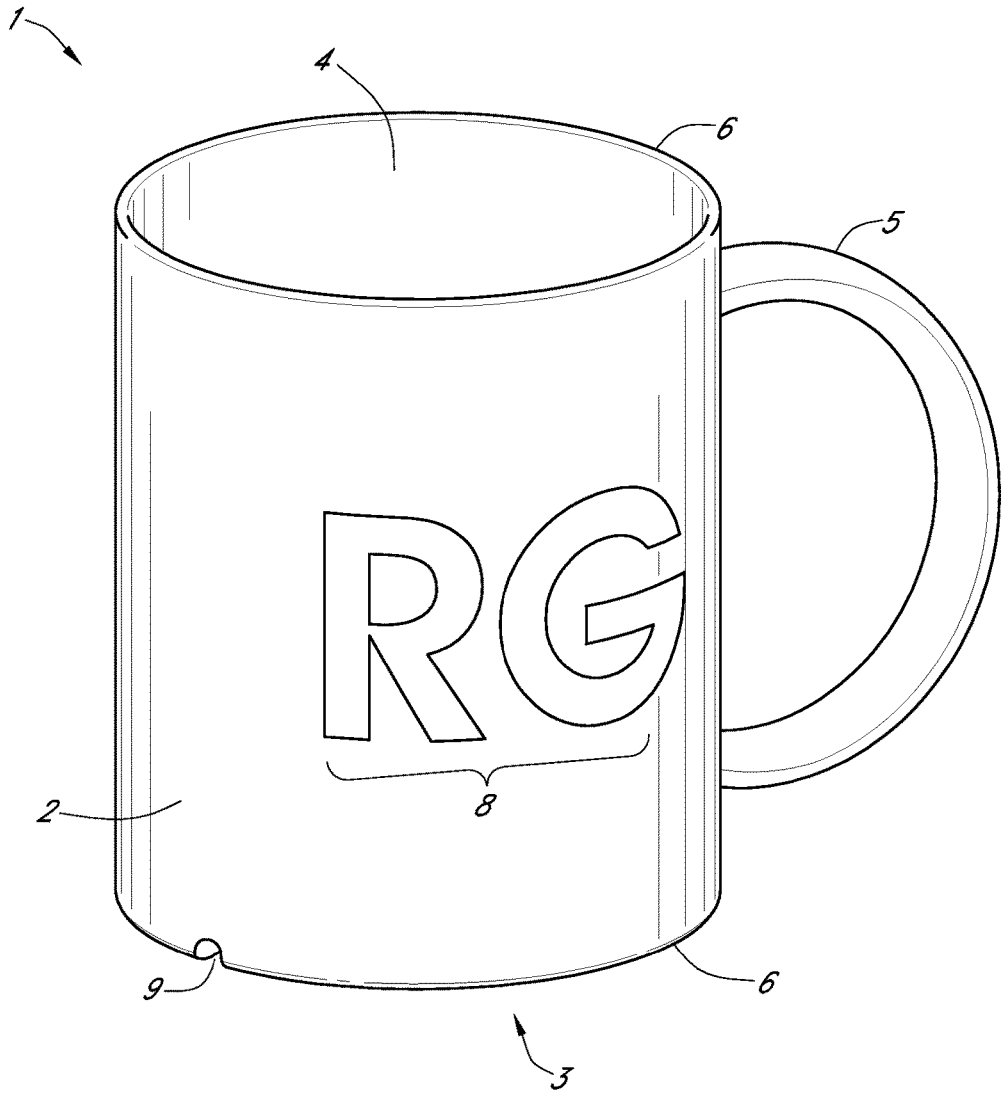
FIG. 4 is a front perspective view of another embodiment of a beverage container.

In another embodiment, illustrated by FIGS. 4-5, at least one displacement channel 9 is positioned in the rim 6 of base 3. The displacement channel 9 allows a portion of the spilled liquid 11 positioned on wet surface 14 to evacuate from under the base 3 of the beverage container 1 to improve delineation of the personal identifier wet and dry surfaces, 8*a* and 8*b*, respectively, thereby improving identification characteristics of the formed personally identifiable stain 13 upon the dry surface 18, illustrated as a piece of paper in FIG. 3C, without limitation. Those of ordinary skill in the art will appreciate the displacement channel should be sized and configured as a notch or depression, shown as 9*a* and 9*b*, respectively to allow a portion of the liquid 11 to evacuate from under the base 3, without reducing the function of the base 3 to support the beverage container 1 or the rim 6 to surround sufficient liquid 11 for the personal identifier 8 to act upon.

Illustrative Method of Use

As illustrated by FIGS. 1-5, the method of personalizing a stain disclosed and claimed herein comprises allowing a liquid 12 to leave a beverage container 1 and accumulate upon a surface 14 (also referred to as the "wet" or first surface 14). A beverage container 1 is then positioned in the spilled liquid 11 on the wet surface 14, allowing the transfer of a portion of the accumulated spilled liquid 11 under the base 3 from the wet surface 14 to the surface(s) of the personal identifier 8 to "wet" these surfaces as well. One of ordinary skill will appreciate that wet (first) surface 14 can be a desk top, a table or a counter, without limitation and with no additional discussion necessary. Thereafter, placing the beverage container 1 upon a dry surface 18 (also referred to as the second surface 18) which is unique from the wet surface 14, allows transfer of a portion of the spilled liquid 11 collected upon the personal identifier 8 surface(s) to the dry (second) surface 18, as illustrated in FIG. 3C, without limitation as paper, but could also be any object or material which will allow the transfer of spilled liquid 11 to form a personally identifiable stain 13, including fabric and absorbent materials.

In this way, the occasional spill from a user's beverage container, such as a coffee mug, upon a surface, and subsequent wetting of the bottom of the beverage container, is transformed from simply an inconvenience, typically resulting in a boring, generic "coffee ring" on the next item the coffee mug is placed upon, to an opportunity for personal branding and expression. The personal identifier 8, may be chosen to be reflective of the beverage container's owner or its owner's interests or favorite brands, and expresses any message the owner wishes to convey via the personally identifiable stain 13 produced upon the dry (second) surface 18 upon which the beverage container 1 is placed. Additionally, this personal expression or branding may be further reflected by having the personal identifier 8 affixed in at least one additional position upon the side surface 2 of the beverage container 1. Although not shown, one of ordinary skill will appreciate the present disclosure may be practiced via a customized Internet website allowing a user to select a personal identifier 8 to produce a personalized beverage container 1.

Having described the preferred embodiments, other features of the method and apparatus of personal stain identification will undoubtedly occur to those versed in the art, as will numerous modifications and alterations in the embodiments as illustrated herein, all of which may be achieved without departing from the spirit and scope of the method and apparatus of stain identification.

It should be noted that the method and apparatus of personal stain identification are not limited to the specific embodiments pictured and described herein, but are intended to apply to all similar apparatuses and methods and apparatus of stain identification. Modifications and alterations from the described embodiments will occur to those skilled in the art without departure from the spirit and scope of the method and apparatus of stain identification disclosed and claimed herein.

In the foregoing Description of Exemplary Embodiments, various features are grouped together in a single embodiment for purposes of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Description of the Exemplary Embodiments, with each claim standing on its own as a separate embodiment of the disclosure.

The invention claimed is:

1. A method of generating a personally identifiable stain comprising:

a. Allowing a liquid to leave a beverage container and accumulate upon a first surface;

b. Positioning said beverage container in said accumulated liquid upon said first surface, wherein said beverage container further comprises:

i. a base, a side surface, an upper end, and an interior volume formed by said base and said side surface; and, ii. A personal identifier is positioned upon said base of said beverage container;

c. Collecting a portion of said accumulated liquid upon at least one surface of said personal identifier by contact between said accumulated liquid and said at least one surface of said personal identifier; and, d. Transferring said portion of said accumulated liquid upon said at least one surface of said personal identifier to a second surface; and, e. Removing said container from said surface to leave said portion of said accumulated liquid formed into a stain upon said second surface.

2. The method of generating a personally identifiable stain according to claim 1 wherein said personal identifier is affixed in at least one additional position upon said side surface of said beverage container.

3. The method of generating a personally identifiable stain according to claim 1 wherein said personal identifier is recessed into said base of said beverage container.

4. The method of generating a personally identifiable stain according to claim 1 wherein said personal identifier extends away from said base of said beverage container.

5. The method of generating a personally identifiable stain according to claim 1 wherein at least one displacement channel is positioned in the rim of said base wherein said displacement channel allows transfer of liquid away from said beverage container.

6. The method of generating a personally identifiable stain according to claim 2 wherein at least one displacement channel is positioned in the rim of said base wherein said displacement channel allows transfer of liquid away from said beverage container.

7. The method of generating a personally identifiable stain according to claim 2 wherein said personal identifier affixed to said base is the mirror image of said personal identifier affixed to said side surface.

8. A method of generating a personally identifiable stain comprising:

a. Positioning a beverage container upon a first surface, wherein said first surface is wet with a liquid from said beverage container, wherein said beverage container further comprises:
   i. a base, a side surface, an upper end, and an interior volume formed by said base and said side surface; and,
   ii. A personal identifier is positioned upon said base of said beverage container;

b. Transferring a portion of liquid upon said wet surface to at least one of said personal identifier's surfaces; and, c. Positioning said beverage container upon a dry surface to allow transfer of said portion of said liquid to said dry surface; and, d. Removing said container from said dry surface to leave said portion of said liquid upon said dry surface formed to represent the shape of said personal identifier.

9. A method of generating a personally identifiable stain according to claim 8 wherein said personal identifier is affixed to said base and is the mirror image of a personal identifier affixed to said side surface of said beverage container and said liquid is staining.

* * * * *